US007922371B2

(12) United States Patent
Qin

(10) Patent No.: US 7,922,371 B2
(45) Date of Patent: Apr. 12, 2011

(54) THERMAL MODULE FOR LIGHT-EMITTING DIODE

(75) Inventor: Teng-Zhi Qin, Shenzhen (CN)

(73) Assignee: Asia Vital Components Co., Ltd., Taipei County (TW)

( * ) Notice: Subject to any disclaimer, the term of this patent is extended or adjusted under 35 U.S.C. 154(b) by 221 days.

(21) Appl. No.: 12/316,994

(22) Filed: Dec. 18, 2008

(65) Prior Publication Data

US 2010/0014299 A1 Jan. 21, 2010

(30) Foreign Application Priority Data

Jul. 21, 2008 (TW) ..... 97212959 U

(51) Int. Cl.
*F21V 29/00* (2006.01)

(52) U.S. Cl. ..... 362/373; 362/249.02

(58) Field of Classification Search ..... 362/218, 362/249.02, 294, 373
See application file for complete search history.

(56) References Cited

U.S. PATENT DOCUMENTS

| | | | | |
|---|---|---|---|---|
| 6,517,218 | B2 | 2/2003 | Hochstein | 362/294 |
| 7,236,366 | B2 | 6/2007 | Chen | 361/709 |
| 7,674,012 | B1 * | 3/2010 | Lin et al. | 362/249.02 |
| 7,744,257 | B2 * | 6/2010 | Zhou et al. | 362/373 |
| 2009/0147522 | A1 * | 6/2009 | Shuai et al. | 362/294 |
| 2010/0157606 | A1 * | 6/2010 | Roucoules et al. | 362/294 |
| 2010/0208460 | A1 * | 8/2010 | Ladewig et al. | 362/249.02 |

* cited by examiner

*Primary Examiner* — David V Bruce

(57) ABSTRACT

A thermal module for LED includes a base in direct contact with an LED module; a first radiating fin assembly consisting of a plurality of parallelly spaced radiating fins and being connected at one side to the base opposite to the LED module; at least one second radiating fin assembly consisting of a plurality of parallelly spaced radiating fins, so that an air passage is provided between any two adjacent radiating fins of the second radiating fin assembly; and at least one heat pipe having a conducting section extended through and closely bearing against an interface between the base and the first radiating fin assembly, and at least one radiating section outward extended from an end of the conducting section to extend through the second radiating fin assembly. The second radiating fin assembly and the air passages thereof largely upgrade the heat dissipating efficiency of the thermal module.

3 Claims, 4 Drawing Sheets

THERMAL MODULE FOR LIGHT-EMITTING DIODE

FIELD OF THE INVENTION

The present invention relates to a thermal module, and more particularly, to a thermal module for light-emitting diode.

BACKGROUND OF THE INVENTION

Techniques for manufacturing highly bright light-emitting diodes (LEDs) and white LED shave become matured, allowing the LEDs to be widely applied to desk lamps, projector lamps, street lamps, etc. Now, LED lamps tend to gradually replace the incandescent lamps with tungsten filament and become a major light source for indoor illumination.

In the traditional incandescent lamp, a large current is supplied to flow through the tungsten filament, so that the tungsten filament is heated to glow and emit light. Unlike the conventional tungsten filament lamp, the LED is a semiconductor element. When the electrons and holes in the semiconductor material of the LED join one another to release energy, light is emitted. Therefore, only a very low current is needed to excite the LED to emit very bright light.

The LED consumes less power and is therefore energy-saving and can reduce the greenhouse effect, compared to the traditional incandescent lamp. However, the LED also encounters the problem of heat dissipation. The heat generated by the LED increases with the increased brightness of the emitted light. In the event the generated heat is not timely removed from the LED, it would adversely shorten the service life of the LED, and even burn out the electronic elements nearby the LED. Therefore, it has become a quite important issue in the LED field to find a way to efficiently dissipate the heat generated by the LED.

FIG. 1 shows a conventional heat sink for LED, which includes a radiating fin assembly 10, a base 11, and an LED module 12. The radiating fin assembly 10 consists of a plurality of radiating fins 100 connected at an end to an upper surface of the base 11 by welding. The LED module 12 is arranged beneath a lower surface of the base 11. When the LED module 12 emits visible light and generates heat, the heat is conducted via the base 11 to the radiating fin assembly 10. Through heat exchange between the radiating fins 100 and air flowing through the radiating fin assembly 10, heat conducted to the radiating fins 100 is carried away by the air and dissipates into ambient environment. However, in the process of heat dissipating, due to the base 11 located between the LED module 12 and the radiating fin assembly 10, air below the LED module can not flow to the radiating fin assembly 10 directly, but has to pass by outer sides of the base 11. As a result, the air is distributed in different directions without being concentrated to the radiating fin assembly 10. That is, the heat-exchange is conducted only between part of the air and the radiating fin assembly 10. Therefore, heat conducted to the radiating fin assembly 10 could not be effectively removed to thereby result in poor heat dissipating effect. Moreover, the above-described conventional heat sink also has limited heat dissipating areas. In brief, the conventional heat sink for LED has the following disadvantages: (1) providing only very limited heat-dissipating areas; and (2) having poor heat-dissipating effect.

SUMMARY OF THE INVENTION

A primary object of the present invention is to provide a thermal module for LED that provides upgraded heat dissipating efficiency.

Another object of the present invention is to provide a thermal module for LED, which has increased heat-dissipating areas.

A further object of the present invention is to provide a thermal module for LED, which provides increased heat-dissipating spaces.

To achieve the above and other objects, the thermal module for LED according to the present invention includes a base in direct contact with an LED module; a first radiating fin assembly consisting of a plurality of parallelly spaced radiating fins and being connected at one side to the base opposite to the LED module; at least one second radiating fin assembly consisting of a plurality of parallelly spaced radiating fins, so that an air passage is provided between any two adjacent radiating fins of the second radiating fin assembly; and at least one heat pipe having a conducting section extended through and closely bearing against an interface between the base and the first radiating fin assembly, and at least one radiating section outward extended from an end of the conducting section to extend through the second radiating fin assembly.

Heat generated by the LED module during the operation thereof is transferred to the heat pipe via the base, and then conducted by the heap pipe to the first and the second radiating fin assemblies. The heat conducted to the first radiating fin assembly is radiated from the radiating fins thereof; and the heat conducted to the second radiating fin assembly is, on the one hand, radiated from the radiating fins of the second radiating fin assembly and, on the other hand, carried away by air flowing through the air passages on the second radiating fin assembly. Therefore, the thermal module has largely upgraded heat dissipating efficiency.

According to the above arrangements, the thermal module for LED according to the present invention has the following advantages: (1) providing increased heat-dissipating areas; and (2) having largely upgraded heat dissipating efficiency and enhanced heat dissipating performance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
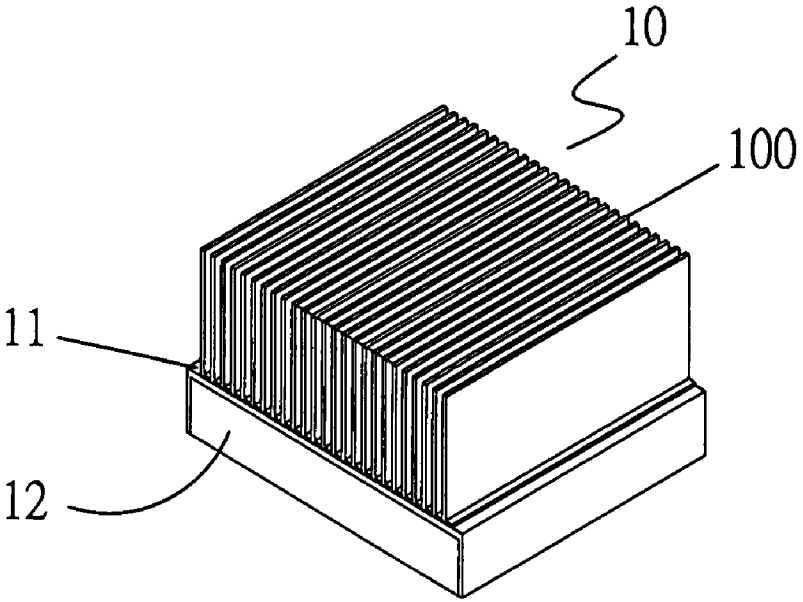
Fig.1(PRIOR ART)
FIG. 1 is an assembled perspective view of a conventional heat sink for LED.
Figure 2:
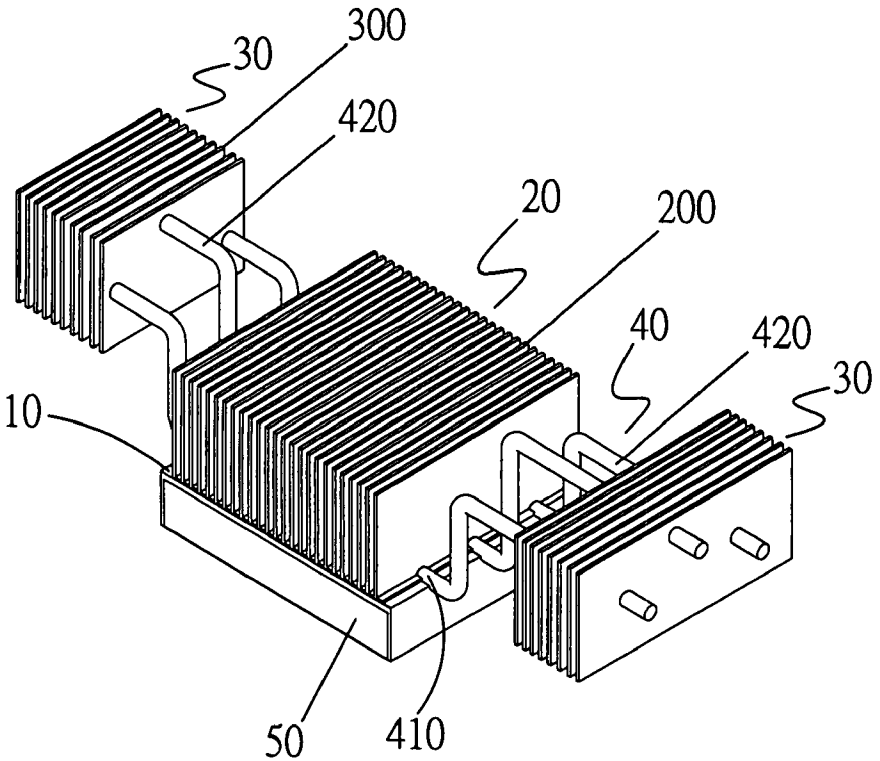
FIG. 2 is an assembled perspective view of a thermal module for LED according to a preferred embodiment of the present invention.
Figure 3:
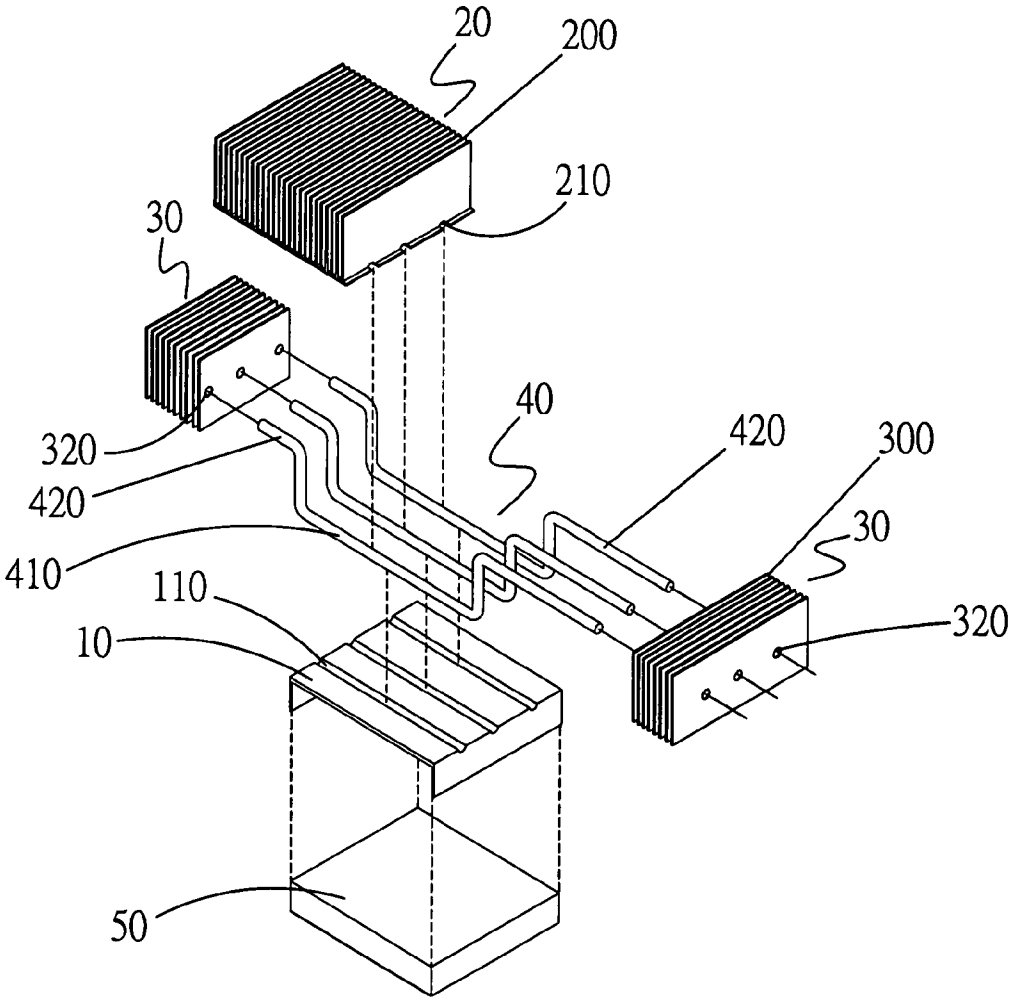
FIG. 3 is an exploded perspective view of the thermal module for LED of FIG. 2.
Figure 4:
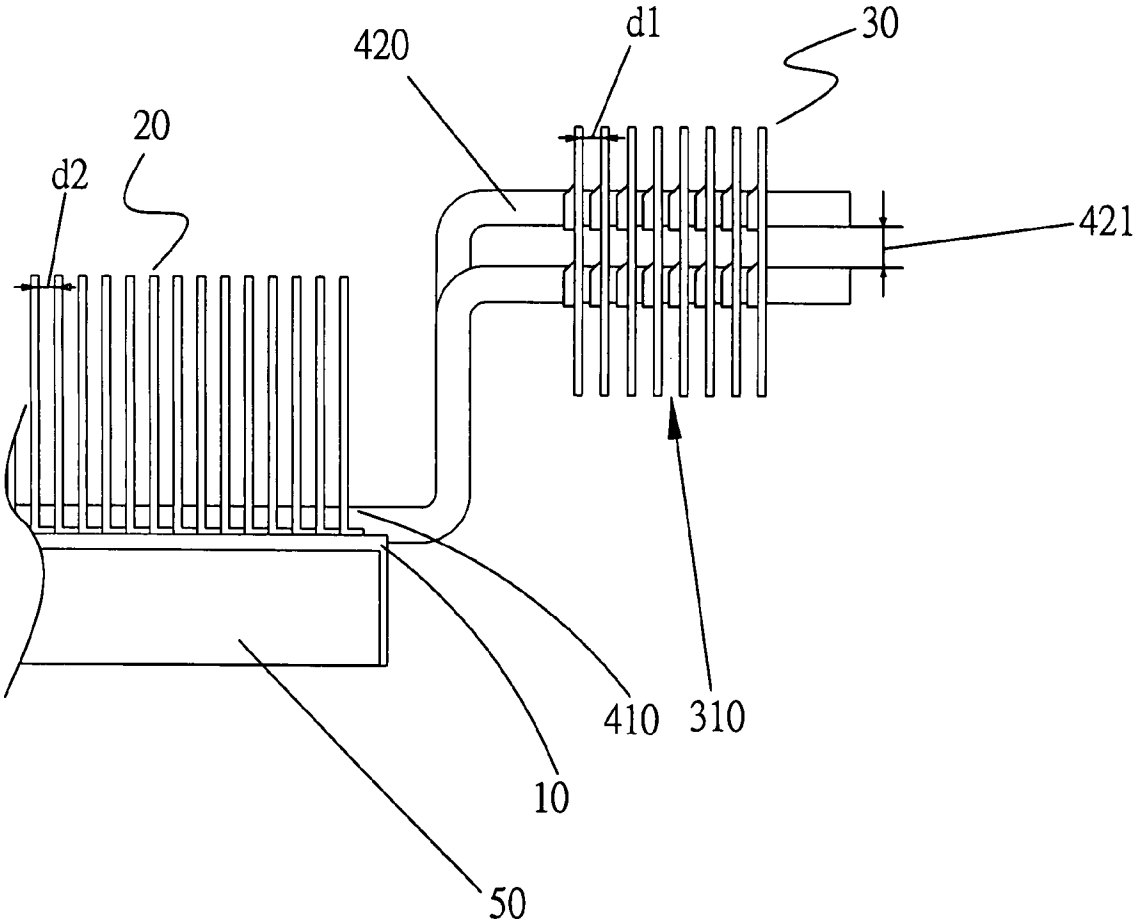
FIG. 4 is an enlarged fragmentary front view of the thermal module for LED according to the present invention.

Please refer to FIGS. 2 and 3 that are assembled and exploded perspective views, respectively, of a thermal module for LED according to a preferred embodiment of the present invention, and to FIG. 4 that is an enlarged fragmentary front view of the present invention. As shown, the thermal module for LED according to the preferred embodiment of the present invention includes a base 10, a first radiating fin assembly 20, at least one second radiating fin assembly 30, and at least one heat pipe 40. An LED module 50 is in direct contact with one of two opposite sides of the base 10. In the illustrated embodiment, there are provided two second radiating fin assemblies 30. Each of the second radiating fin assemblies 30 consists of a plurality of parallelly arranged radiating fins 300 with a space d1 existing between any two adjacent radiating fins 300 to provide an air passage 310. Heat-carrying airflows (not shown) can smoothly and quickly flow through the air passages 310. With the parallelly spaced radiating fins 300, the second radiating fin assembly 30 has increased heat radiating areas and allows heat carried by the airflows flowing therethrough to quickly dissipate into ambient air.

The first radiating fin assembly 20 consists of a plurality of parallelly arranged radiating fins 200 with a space d2 existing between any two adjacent radiating fins 200. The first radiating fin assembly 20 is connected at one side to the other side of the base 10 opposite to the LED module 50.

The heat pipe 40 includes a conducting section 410 and at least one radiating section 420. The conducting section 410 is extended through an interface between the base 10 and the first radiating fin assembly 20 to closely bear against the base 10 and the first radiating fin assembly 20. In the illustrated embodiment, two radiating sections 420 are outward extended from two opposite ends of the conducting section 410 in two directions away from the base 10 to extend through the second radiating fin assemblies 30. With the heat pipe 40 extended among the base 10, the first radiating fin assembly 20, and the second radiating fin assemblies 30, the thermal module for LED according to the present invention can have increased heat-radiating areas and upgraded heat-dissipating efficiency.

As can be seen from FIG. 3, the first radiating fin assembly 20 is provided on the side contacting with the base 10 with at least one groove 210, while the base 10 is correspondingly provided on the side contacting with the first radiating fin assembly 20 with at least one groove 110, so that the groove 210 and the groove 110 together define a long hole for receiving the conducting section 410 of the heat pipe 40 therein. Each of the second radiating fin assemblies 30 is provided with at least one through hole 320 for a free end of the radiating section 420 to extend thereinto. The through hole 320 can have a circular, a half-elliptic, a semicircular, or a triangular cross-sectional shape, and the radiating sections 420 each have a cross-sectional shape corresponding to that of the through holes 320 on the second radiating fin assemblies 30.

Please now refer to FIG. 4. In the case more than one heat pipe 40 is provided for the thermal module for LED according to the present invention, the radiating sections 420 of the heat pipes 40 are orderly arranged to extend into each of the second radiating fin assemblies 30 at different heights. More specifically, the radiating sections 420 each are continuously bent to include an upright segment between a lower and a higher horizontal segment. The upright segments and the lower horizontal segments on different radiating sections 420 are different in length, so that a heat-dissipating space 421 is maintained between any two adjacent upper horizontal segments of the radiating sections 420 to help in smooth flowing of heat-carrying air through between the radiating sections 420 to achieve enhanced heat exchange for effectively carrying heat away from the thermal module. Therefore, the thermal module can have upgraded heat-dissipating efficiency.

When the LED module 50 emits visible light, it also generates heat. The heat generated by the LED module 50 is first absorbed by the base 10, and then transferred from the base 10 to the conducting sections 410 of the heat pipes 40. Part of the heat transferred to the conducting sections 410 is conducted via the conducting sections 410 to the radiating sections 420, while other part of the heat is conducted to the first radiating fin assembly 20. The heat conducted to the first radiating fin assembly 20 are radiated from the radiating fins 200 and dissipated into ambient air. Mean while, the heat conducted to the radiating sections 420 is further conducted to the radiating fins 300 of the second radiating fin assembly 30. When air flows through the air passages 310 existing among the radiating fins 300 and the heat-dissipating spaces 421 among the radiating sections 420, heat conducted to and/or stagnated around the radiating fins 300 is carried away by the air through heat exchange. Accordingly, the heat conducted to the second radiating fin assembly 30 can be dissipated not only through radiating into ambient air, but also be carried away by air through heat exchange between the radiating fins 300 and the air flowing through the air passages 310 and the heat-dissipating spaces 421. Therefore, the heat-dissipating efficiency of the thermal module can be largely upgraded.

According to the above arrangements, the thermal module for LED according to the present invention has the following advantages: (1) providing increased heat-dissipating spaces; (2) enabling enhanced heat dissipating performance; and (3) providing increased heat-dissipating areas.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A thermal module for LED, comprising:

a base having one of two sides in direct contact with an LED module;

a first radiating fin assembly consisting of a plurality of parallelly arranged and spaced radiating fins, and being connected at one side to the other side of the base opposite to the LED module;

at least one second radiating fin assembly consisting of a plurality of parallelly arranged and spaced radiating fins, so that an air passage is provided between any two adjacent radiating fins of the second radiating fin assembly;

at least one heat pipe having a conducting section and at least one radiating section; the conducting section being extended through an interface between the base and the first radiating fin assembly to closely bear against the base and the first radiating fin assembly; and the at least one radiating section being outward extended from an end of the conducting section in a direction away from the base to extend through the second radiating fin assemblies;

wherein the first radiating fin assembly is provided on the side contacting with the base with at least one groove; and wherein the base is correspondingly provided on the side contacting with the first radiating assembly with at least one groove, so that the groove on the base and the groove on the first radiating fin assembly together define a long hole for receiving the conducting section of the heat pipe therein.

2. A thermal module for LED, comprising:

a base having one of two sides in direct contact with an LED module;

a first radiating fin assembly consisting of a plurality of parallelly arranged and spaced radiating fins, and being connected at one side to the other side of the base opposite to the LED module;

at least one second radiating fin assembly consisting of a plurality of parallelly arranged and spaced radiating fins, so that an air passage is provided between any two adjacent radiating fins of the second radiating fin assembly;

at least one heat pipe having a conducting section and at least one radiating section; the conducting section being extended through an interface between the base and the first radiating fin assembly to closely bear against the base and the first radiating fin assembly; and the at least one radiating section being outward extended from an end of the conducting section in a direction away from the base to extend through the second radiating fin assemblies; and wherein, more than one heat pipe is provided, and the radiating sections extended from the conducting sections of the heat pipes being continuously bent to each include at least one upright segment extended between a lower horizontal segment and a higher horizontal segment, and the upright segments and the lower horizontal segments of different radiating sections are different in length.

3. The thermal module for LED as claimed in claim 2, wherein a heat-dissipating space is provided between the upper horizontal segments on any two adjacent radiating sections.

* * * * *